US010428683B2

(12) United States Patent
Eriksen et al.

(10) Patent No.: US 10,428,683 B2
(45) Date of Patent: Oct. 1, 2019

(54) ABRASIVE GEL DETERGENT FOR CLEANING GAS TURBINE ENGINE COMPONENTS

(71) Applicant: General Electric Company, Schenectady, NY (US)

(72) Inventors: Michael Edward Eriksen, Cincinnati, OH (US); David E. Caldwell, West Chester, OH (US); Nicole Jessica Tibbetts, Delanson, NY (US); Ambarish Jayant Kulkarni, Glenville, NY (US); Byron Andrew Pritchard, Jr., Loveland, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/987,883

(22) Filed: Jan. 5, 2016

(65) Prior Publication Data

US 2017/0191376 A1 Jul. 6, 2017

(51) Int. Cl.
*B24C 3/32* (2006.01)
*F01D 25/00* (2006.01)
(Continued)

(52) U.S. Cl.
CPC ..... *F01D 25/002* (2013.01); *B24C 1/00* (2013.01); *B24C 3/327* (2013.01); *B24C 11/00* (2013.01);
(Continued)

(58) Field of Classification Search
CPC ..... B24B 31/116; B24C 11/00; B24C 3/32
(Continued)

(56) References Cited

U.S. PATENT DOCUMENTS 2,708,157 A * 5/1955 Houser ..... C11D 9/20 106/414
2,948,092 A * 8/1960 Fuller ..... F01D 25/002 451/36

(Continued)

FOREIGN PATENT DOCUMENTS

CH S60056 A5 3/1987
CN 1092135 A 9/1994

(Continued)

OTHER PUBLICATIONS

Extended European Search Report and Opinion issued in connection with corresponding EP Application No. 16204858.1 dated Jun. 13, 2017.

(Continued)

*Primary Examiner* — Robert A Rose
(74) *Attorney, Agent, or Firm* — Dority & Manning, P.A.

(57) ABSTRACT

The present disclosure is directed to a method for in-situ cleaning one or more components of a gas turbine engine using an abrasive gel detergent. More specifically, the gel detergent includes a plurality of abrasive particles suspended in a gel composition. Further, the abrasive particles include organic material. Moreover, the gel composition is formed of a mixture of detergent particles dissolved in a gel reactant. Thus, the method includes injecting the gel detergent into at least a portion of the gas turbine engine at a predetermined pressure. In addition, the method includes allowing the gel detergent to flow across or within one or more of the components of the gas turbine engine so as to clean one or more of the components.

13 Claims, 5 Drawing Sheets

(51) Int. Cl.

| | |
|---|---|
| ***B24C 1/00*** | (2006.01) |
| ***C11D 3/20*** | (2006.01) |
| ***C11D 3/38*** | (2006.01) |
| ***C11D 11/00*** | (2006.01) |
| ***C11D 17/00*** | (2006.01) |
| ***B24C 11/00*** | (2006.01) |
| ***C11D 3/14*** | (2006.01) |

(52) U.S. Cl.
CPC ..... *C11D 3/14* (2013.01); *C11D 3/2075* (2013.01); *C11D 3/38* (2013.01); *C11D 11/0041* (2013.01); *C11D 17/003* (2013.01); *C11D 17/0013* (2013.01); *F05D 2220/32* (2013.01)

(58) Field of Classification Search
USPC ..... 451/104, 113, 37, 75, 38, 39, 40, 2, 76, 451/57, 27
See application file for complete search history.

(56) References Cited

U.S. PATENT DOCUMENTS 3,033,711 A * 5/1962 Harding ..... B24C 3/32 134/7
3,619,962 A * 11/1971 Combe ..... C11D 17/0013 106/14.13
3,705,688 A 12/1972 Smale
4,005,549 A * 2/1977 Perry ..... B24B 31/116 451/36
4,087,943 A * 5/1978 Perry ..... C08G 77/398 451/36
5,001,638 A 3/1991 Zimmerman et al.
5,002,078 A * 3/1991 Kaes ..... C11D 3/2093 134/19
5,058,379 A 10/1991 Lardellier
5,367,833 A * 11/1994 Rhoades ..... B24B 31/116 451/36
5,512,071 A * 4/1996 Yam ..... B08B 7/00 134/7
5,611,462 A 3/1997 Barkes
5,858,111 A 1/1999 Marrero
6,310,022 B1 10/2001 Amiran
6,371,407 B1 4/2002 Renshaw
6,478,033 B1 11/2002 Foster
6,491,048 B1 12/2002 Foster
6,503,334 B2 1/2003 Ruiz et al.
6,553,768 B1 4/2003 Trewin et al.
6,630,198 B2 10/2003 Ackerman et al.
7,531,048 B2 5/2009 Woodcock et al.
7,770,377 B2 8/2010 Rolt
8,197,609 B2 6/2012 Alvestig et al.
8,216,392 B2 7/2012 Giljohann et al.
8,245,952 B2 8/2012 de la Bruere-Terreault et al.
8,303,243 B2 11/2012 Fish et al.
8,489,306 B2 7/2013 Sahm et al.
8,632,299 B2 1/2014 Eleftheriou et al.
9,028,618 B2 5/2015 Battaglioli et al.
9,034,111 B2 5/2015 Dorshimer et al.
2002/0103093 A1 8/2002 LaGraff et al.
2004/0255422 A1 12/2004 Reback et al.
2005/0049168 A1 3/2005 Yan et al.
2006/0243308 A1 11/2006 Asplund et al.
2007/0051091 A1 3/2007 Rolt
2010/0126635 A1* 5/2010 Bhowal ..... B24B 19/14 148/405
2010/0144247 A1* 6/2010 Lunn ..... B24B 31/116 451/36
2011/0005142 A1 1/2011 Mase et al.
2013/0017071 A1 1/2013 Goller et al.
2013/0019895 A1 1/2013 Hughes et al.
2013/0174869 A1 7/2013 Rosing et al.
2013/0199040 A1 8/2013 Dudeck et al.
2014/0083079 A1 3/2014 Kupratis et al.
2015/0159122 A1 6/2015 Tibbetts et al.

FOREIGN PATENT DOCUMENTS

| | | | |
|---|---|---|---|
| CN | 102877895 | | 1/2013 |
| DE | 10 2008 019 892 | A1 | 10/2009 |
| EP | 2 226 467 | A2 | 9/2010 |
| GB | 829 921 | A | 3/1960 |
| WO | 2005/049239 | A1 | 6/2005 |
| WO | 2009/105043 | A1 | 8/2009 |
| WO | 2009/129788 | A1 | 10/2009 |

OTHER PUBLICATIONS

Office Action issued in connection with corresponding CN Application No. 201710006524.5 dated May 24, 2018.

* cited by examiner

ABRASIVE GEL DETERGENT FOR CLEANING GAS TURBINE ENGINE COMPONENTS

FIELD OF THE INVENTION

The present subject matter relates generally to gas turbine engines, and more particularly, to an abrasive gel detergent for in-situ cleaning of gas turbine engine components.

BACKGROUND OF THE INVENTION

A gas turbine engine generally includes, in serial flow order, a compressor section, a combustion section, a turbine section and an exhaust section. In operation, air enters an inlet of the compressor section where one or more axial compressors progressively compress the air until it reaches the combustion section. Fuel is mixed with the compressed air and burned within the combustion section to provide combustion gases. The combustion gases are routed from the combustion section through a hot gas path defined within the turbine section and then exhausted from the turbine section via the exhaust section.

In particular configurations, the turbine section includes, in serial flow order, a high pressure (HP) turbine and a low pressure (LP) turbine. The HP turbine and the LP turbine each include various rotatable turbine components such as turbine rotor blades, rotor disks and retainers, and various stationary turbine components such as stator vanes or nozzles, turbine shrouds, and engine frames. The rotatable and stationary turbine components at least partially define the hot gas path through the turbine section. As the combustion gases flow through the hot gas path, thermal energy is transferred from the combustion gases to the rotatable and stationary turbine components.

During operation, environmental particulate accumulates on engine components. For example, internal cooling surfaces, particularly impingement cooled surfaces such as those of turbine shrouds are prone to the accumulation of environmental particulate, which can become a chemically reacted product. Such accumulation can lead to reduced cooling effectiveness of the components and/or corrosive reaction with the metals and/or coatings of the engine components. Thus, particulate build-up can lead to premature distress and/or reduced engine life.

Accordingly, the present disclosure is directed to a gel detergent and method of using same that addresses the aforementioned issues. More specifically, the present disclosure is directed to a gel detergent configured for in-situ cleaning of gas turbine engine components.

BRIEF DESCRIPTION OF THE INVENTION

Aspects and advantages of the invention will be set forth in part in the following description, or may be obvious from the description, or may be learned through practice of the invention.

In one aspect, the present disclosure is directed to a method for in-situ cleaning one or more components of a gas turbine engine. The method includes injecting a gel detergent into at least a portion of the gas turbine engine at a predetermined pressure. The gel detergent includes a plurality of abrasive particles suspended in a gel composition. Further, the abrasive particles include organic material. The gel composition is formed of a mixture of detergent particles dissolved in a gel reactant. The method also includes allowing the gel detergent to flow across or within one or more of the components of the gas turbine engine so as to clean the component(s).

In another aspect, the present disclosure is directed to a method for in-situ cleaning a component of a gas turbine engine, e.g. such as a turbine blade of the gas turbine engine. The method includes injecting a gel detergent into a cooling passageway of the component of the gas turbine engine. The gel detergent includes a plurality of abrasive particles suspended in a gel composition. Further, the abrasive particles include organic material. The gel composition includes a mixture of detergent particles dissolved in a gel reactant. The method also includes allowing the gel detergent to flow through the cooling passageway so as to clean therein. It should also be understood that the method may further include any of the additional steps, features and/or properties as described herein.

In yet another aspect, the present disclosure is directed to a gel detergent for cleaning a component of a gas turbine engine. The gel detergent is formed from a gel composition having a plurality of abrasive organic particles suspended therein. Further, the gel composition contains a mixture of detergent particles dissolved in a gel reactant. Moreover, each of the abrasive particles has a particle diameter ranging from about 20 microns to about 500 microns. It should also be understood that the gel detergent may further include any of the additional features and/or properties as described herein.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
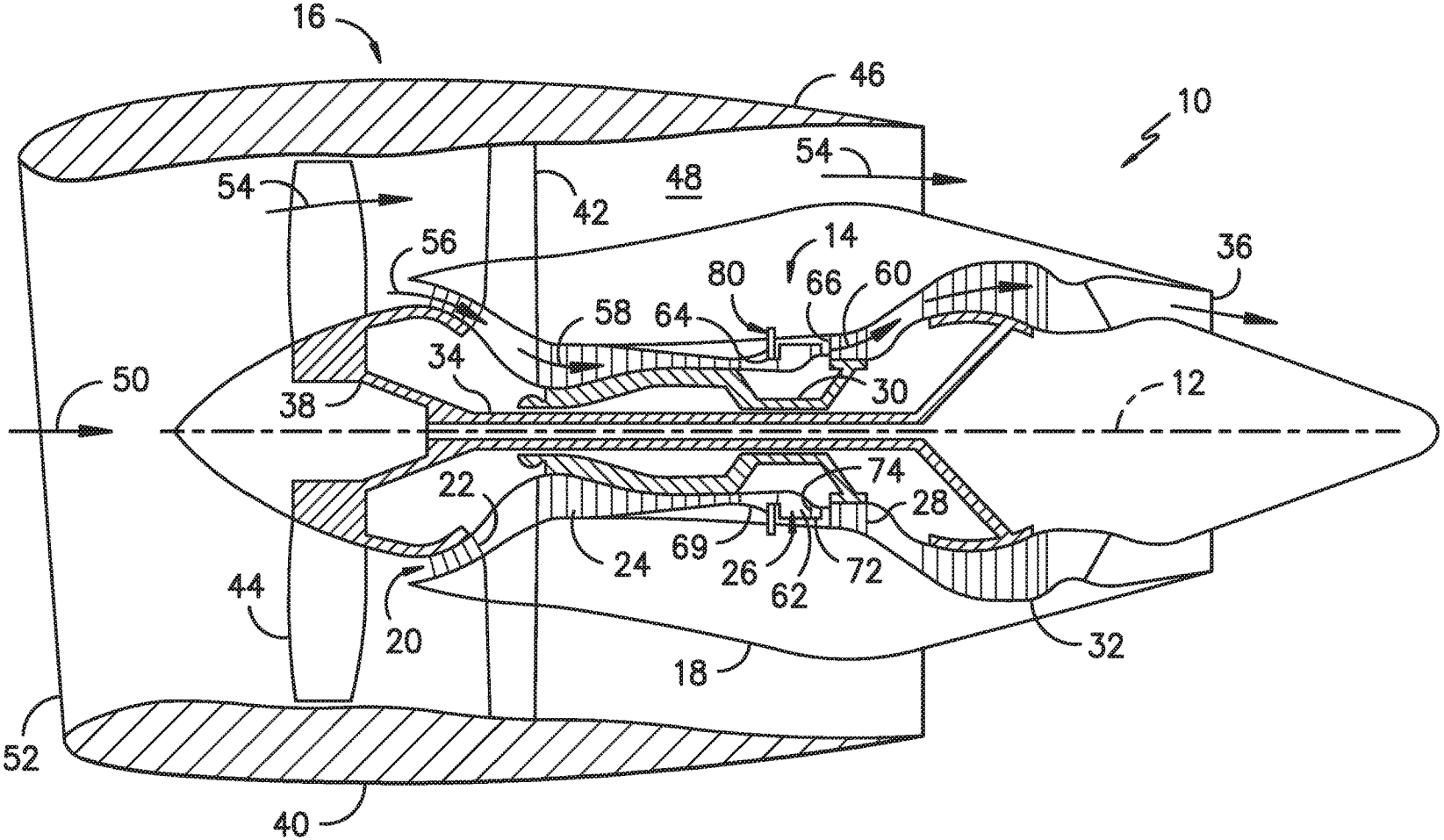
FIG. 1 illustrates a schematic cross-sectional view of one embodiment of a gas turbine engine according to the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Generally, the present disclosure is directed to an abrasive gel detergent that is particularly useful for in-situ or on-wing cleaning of gas turbine engine components. More specifically, the gel detergent includes a plurality of abrasive particles suspended in a gel composition. Further, the gel composition is formed of a mixture of detergent particles dissolved in a gel reactant. Thus, the method includes injecting the gel detergent into a portion of the gas turbine engine at a predetermined pressure. Thus, the method also includes allowing the gel detergent to flow across or within one or more of the components of the gas turbine engine so as to clean one or more of the components.

The present disclosure provides various advantages not present in the prior art. For example, gas turbine engines according to present disclosure can be cleaned on-wing, in-situ, and/or off-site. Further, the cleaning methods of the present disclosure provide simultaneous mechanical and chemical removal of particulate deposits in cooling passages and other areas of gas turbine engines that can have difficult access. In addition, the system and method of the present disclosure improves cleaning effectiveness and has significant implications for engine time on-wing durability.

Referring now to the drawings, FIG. 1 illustrates a schematic cross-sectional view of one embodiment of a gas turbine engine 10 (high-bypass type) according to the present disclosure. As shown, the gas turbine engine 10 has an axial longitudinal centerline axis 12 therethrough for reference purposes. Further, as shown, the gas turbine engine 10 preferably includes a core gas turbine engine generally identified by numeral 14 and a fan section 16 positioned upstream thereof. The core engine 14 typically includes a generally tubular outer casing 18 that defines an annular inlet 20. The outer casing 18 further encloses and supports a booster 22 for raising the pressure of the air that enters core engine 14 to a first pressure level. A high pressure, multistage, axial-flow compressor 24 receives pressurized air from the booster 22 and further increases the pressure of the air. The pressurized air flows to a combustor 26, where fuel is injected into the pressurized air stream and ignited to raise the temperature and energy level of the pressurized air. The high energy combustion products flow from the combustor 26 to a first (high pressure) turbine 28 for driving the high pressure compressor 24 through a first (high pressure) drive shaft 30, and then to a second (low pressure) turbine 32 for driving the booster 22 and the fan section 16 through a second (low pressure) drive shaft 34 that is coaxial with the first drive shaft 30. After driving each of the turbines 28 and 32, the combustion products leave the core engine 14 through an exhaust nozzle 36 to provide at least a portion of the jet propulsive thrust of the engine 10.

The fan section 16 includes a rotatable, axial-flow fan rotor 38 that is surrounded by an annular fan casing 40. It will be appreciated that fan casing 40 is supported from the core engine 14 by a plurality of substantially radially-extending, circumferentially-spaced outlet guide vanes 42. In this way, the fan casing 40 encloses the fan rotor 38 and the fan rotor blades 44. The downstream section 46 of the fan casing 40 extends over an outer portion of the core engine 14 to define a secondary, or bypass, airflow conduit 48 that provides additional jet propulsive thrust.

From a flow standpoint, it will be appreciated that an initial airflow, represented by arrow 50, enters the gas turbine engine 10 through an inlet 52 to the fan casing 40. The airflow passes through the fan blades 44 and splits into a first air flow (represented by arrow 54) that moves through the conduit 48 and a second air flow (represented by arrow 56) which enters the booster 22.

The pressure of the second compressed airflow 56 is increased and enters the high pressure compressor 24, as represented by arrow 58. After mixing with fuel and being combusted in the combustor 26, the combustion products 60 exit the combustor 26 and flow through the first turbine 28. The combustion products 60 then flow through the second turbine 32 and exit the exhaust nozzle 36 to provide at least a portion of the thrust for the gas turbine engine 10.

Still referring to FIG. 1, the combustor 26 includes an annular combustion chamber 62 that is coaxial with the longitudinal centerline axis 12, as well as an inlet 64 and an outlet 66. As noted above, the combustor 26 receives an annular stream of pressurized air from a high pressure compressor discharge outlet 69. A portion of this compressor discharge air flows into a mixer (not shown). Fuel is injected from a fuel nozzle 100 to mix with the air and form a fuel-air mixture that is provided to the combustion chamber 62 for combustion. Ignition of the fuel-air mixture is accomplished by a suitable igniter, and the resulting combustion gases 60 flow in an axial direction toward and into an annular, first stage turbine nozzle 72. The nozzle 72 is defined by an annular flow channel that includes a plurality of radially-extending, circumferentially-spaced nozzle vanes 74 that turn the gases so that they flow angularly and impinge upon the first stage turbine blades of the first turbine 28. As shown in FIG. 1, the first turbine 28 preferably rotates the high-pressure compressor 24 via the first drive shaft 30, whereas the low-pressure turbine 32 preferably drives the booster 22 and the fan rotor 38 via the second drive shaft 34.

The combustion chamber 62 is housed within the engine outer casing 18 and fuel is supplied into the combustion chamber 62 by one or more fuel nozzles 80. More specifically, liquid fuel is transported through one or more passageways or conduits within a stem of the fuel nozzle 80.

Figure 2:
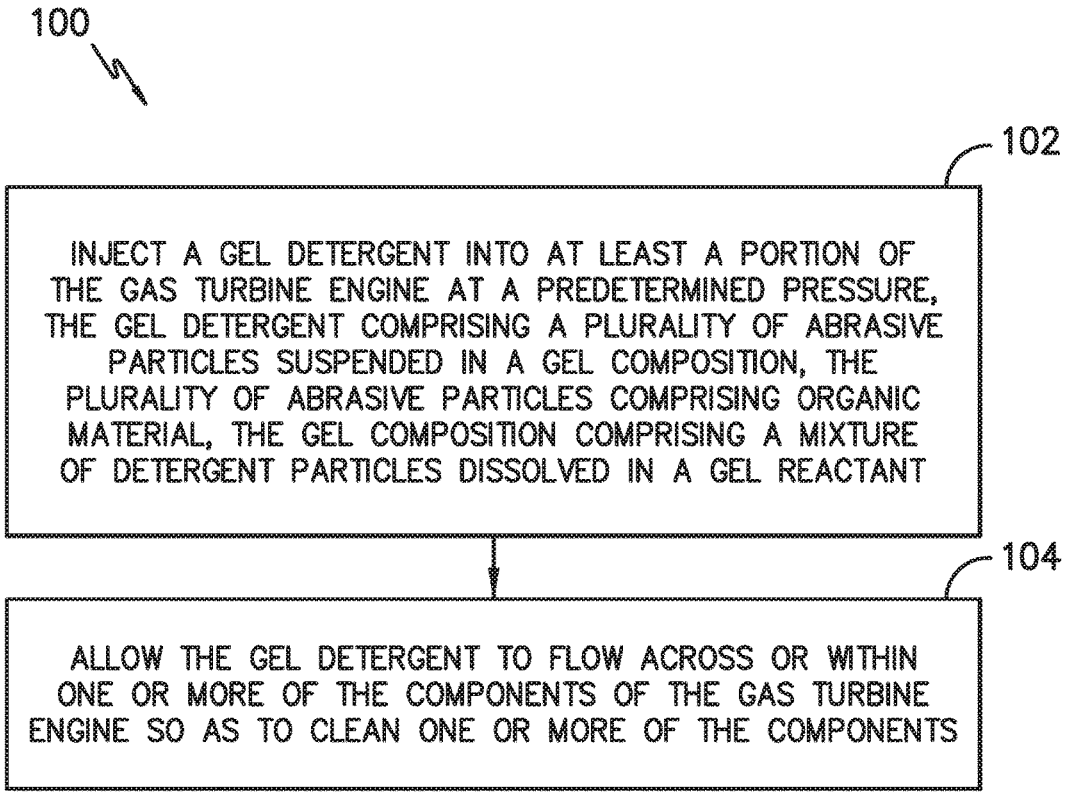
FIG. 2 illustrates a flow diagram of one embodiment of a method for in-situ cleaning of one or more components of a gas turbine engine according to the present disclosure.

Referring now to FIG. 2, a flow diagram of one embodiment of a method 100 for in-situ cleaning one or more components of a gas turbine engine (e.g. such as the gas turbine engine 10 illustrated in FIG. 1) is illustrated. For example, in certain embodiments, the component(s) of the gas turbine engine 10 may include any components of the engine 10 as described herein, including but not limited to the compressor 24, the high-pressure turbine 28, the low-pressure turbine 32, the combustor 26, the combustion chamber 62, one or more nozzles 72, 80, one or more blades 44 or vanes 42, the booster 22, a casing 18 of the gas turbine engine 10, or similar. More specifically, in particular embodiments, the component(s) of the gas turbine engine 10 may include the blades 44 of the high-pressure turbine 28 or the low-pressure turbine 32 of the gas turbine engine 10.

Thus, as shown at 102, the method 100 includes injecting a gel detergent (as indicated by arrow 84 of FIG. 3) into the gas turbine engine 10 at a predetermined pressure. In certain embodiments, the method 100 may include determining the predetermined pressure as a function of at least one of the viscosity of the gel composition or the one or more components of the gas turbine engine 10. In other words, depending on the viscosity of the gel detergent 84 and which component the gel detergent 84 is being injected into, the injection pressure can be modified accordingly.

Figure 3:
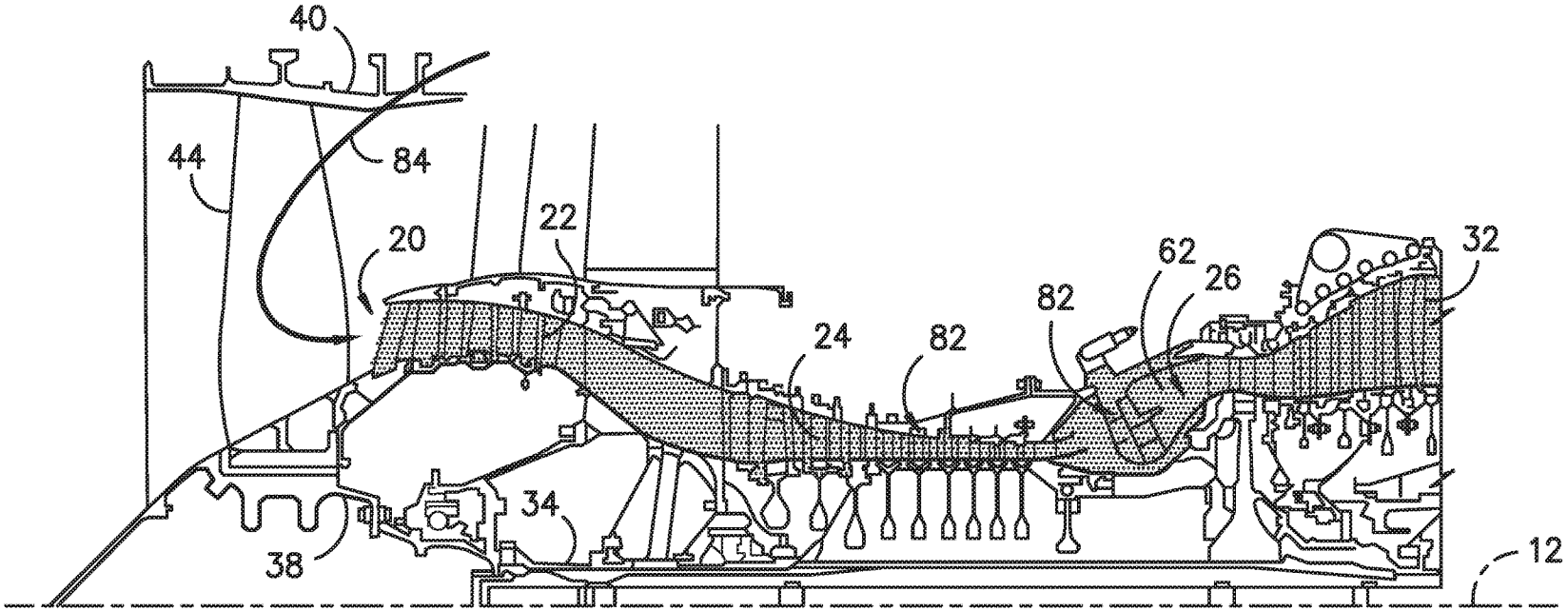
FIG. 3 illustrates a partial, cross-sectional view of one embodiment of a gas turbine engine, particularly illustrating a gel detergent being injected into the engine at a plurality of locations according to the present disclosure.
Figure 4:
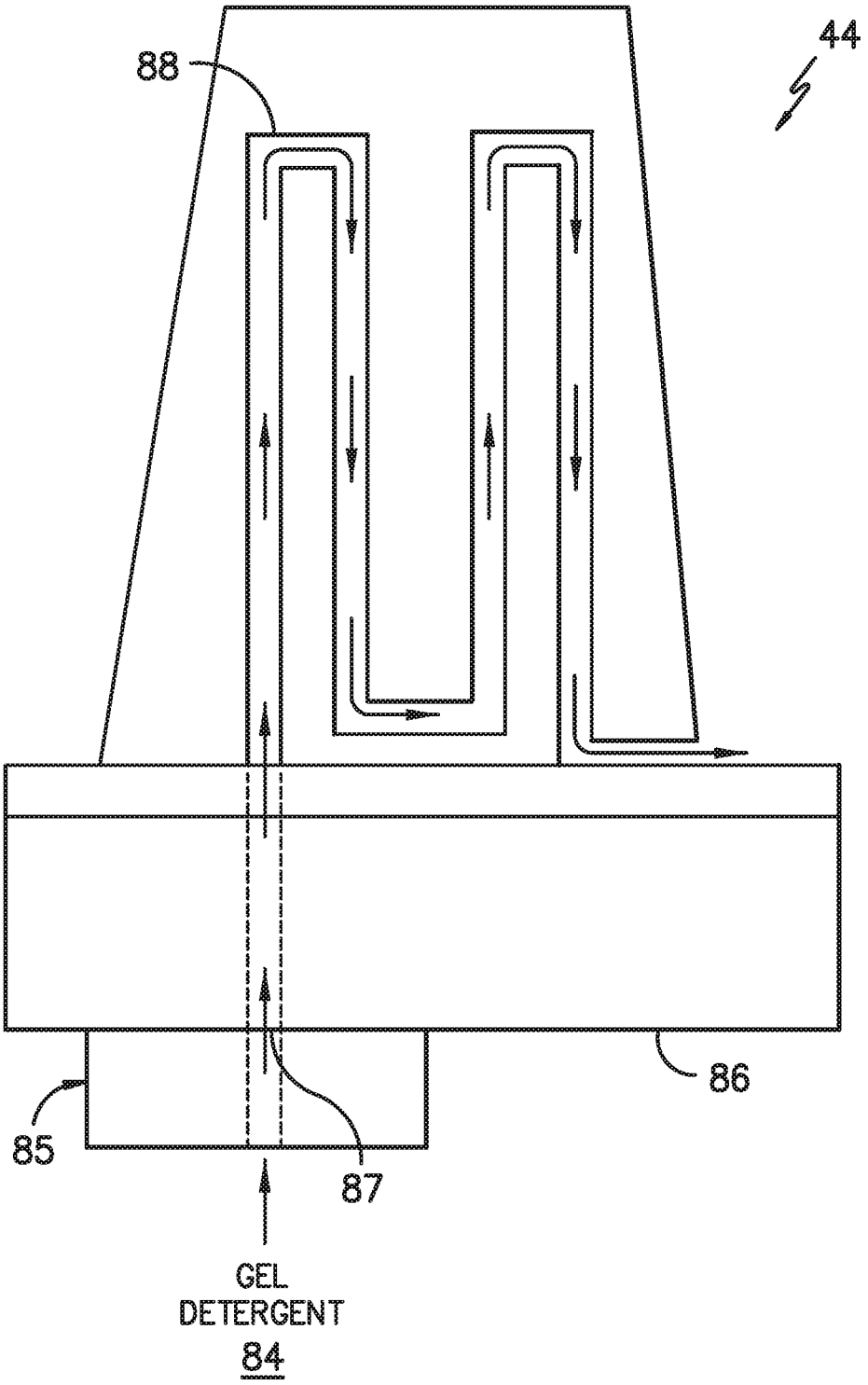
FIG. 4 illustrates a cross-sectional view of one embodiment of a component of a gas turbine engine, particularly illustrating a gel detergent being injected into a cooling passageway of the component according to the present disclosure.

Further, as shown in FIG. 3, the step of injecting the gel detergent 84 into the gas turbine engine 10 may include injecting the gel detergent 84 into an inlet (e.g. inlet 20, 52 or 64) of the engine 10. Alternatively or in addition, as shown, the step of injecting the gel detergent 84 into the gas turbine engine 10 may include injecting the gel detergent 84 into one or more ports 82 of the engine 10. In yet another embodiment, the step of injecting the gel detergent 84 into the gas turbine engine 10 may include injecting the gel detergent 84 into one or more cooling passageways 88 of a component of the engine 10. More specifically, as shown in FIG. 4, a gel supply 85 may be attached to a component surface 86 such that the gel detergent 84 can be injected into an inlet 87 of a cooling passageway 88 of the component, e.g. the blade 44.

The gel detergent 84 of the present disclosure may include any suitable composition now known or later developed in the art. For example, in one embodiment, the gel detergent 84 may include a plurality of abrasive particles suspended in a gel composition. More specifically, the abrasive particles may be formed from organic material. For example, in one embodiment, the organic material may formed from nut shells (e.g. walnut shells) and/or fruit stone pits (e.g. peach, plum, or similar). As such, the organic material or particles can easily burn if left in the engine 10 after cleaning so as to not damage the engine 10 by either blocking cooling circuits or inducing pitting or intergranular corrosion on engine component parent metals or coating systems.

In further embodiments, the organic particles may be present in the gel composition in any suitable concentration and may have any suitable shape. For example, in one embodiment, the organic material may be present from about 3,000 parts per million (ppm) to about 30,000 ppm, i.e. wherein the residual ash content of the organic material does not exceed 0.05% at 1040° C. In addition, the abrasive organic particles may have any suitable particle size so as to not damage the engine components. For example, in one embodiment, the particle diameter of the organic particles may range from about 20 microns to about 500 microns, more preferably from about 20 microns to about 40 microns. In addition, the abrasive particles may have substantially the same particle size or may have varying particle sizes. For example, in certain embodiments, the varying particle sizes may include a first set of particles having a particle diameter within a first, smaller micron range and a second set of particles having a particle diameter within a second, larger micron range. For example, in certain embodiments, the first micron range may be equal to or less than 20 microns, whereas the second micron range may be equal to or greater than 500 microns.

More specifically, the gel composition may be formed of a mixture of detergent particles dissolved in a gel reactant. For example, in certain embodiments, the detergent particles may include biodegradable acidic particles similar to the particles found in CITRANOX® brand detergent sold by Alconox, Inc., 9E 40th St., Room 200, New York, N.Y. 10016 and/or U.S. Patent Application No.: 2015/0159122 entitled "Cleaning Solution and Methods of Cleaning a Turbine Engine" filed on Sep. 12, 2014, which is incorporated herein by reference in its entirety. It should also be understood that the detergent particles may include any suitable dry detergent particles now known or later developed in the art.

In addition, the gel reactant may include one or more polymers with a molecular weight range of from about 1,250,000 to about 3,000,000 Daltons. For example, in certain embodiments, the gel reactant may include a class of polymers of acrylic and carboxylic acids. Commercial examples of such gel reactants may include Carbomer 941® or Carbomer 934P®.

In certain embodiments, the process of forming the gel detergent may include diluting the detergent particles, e.g. using deionized water. The mixture can then be pH buffered with a predetermined amount of a pH buffer, e.g. crystalline imidazole using a pH probe. Thus, when forming the gel detergent, the pH buffer can be used to buffer the solution to a pH ranging from about 5 to about 6, more preferably about 5.5. Further, the process may include adding one or more corrosion inhibitors to the gel composition. For example, in certain embodiments, suitable corrosion inhibitors may include hexamine, phenylenediamine, dimethylethanolamine, sodium nitrite, cinnamaldehyde, condensation products of aldehydes and amines (imines), chromates, nitrites, phosphates, hydrazine, ascorbic acid, or similar. More specifically, in one embodiment, the corrosion inhibitor may include Basacorr™ 2005 brand corrosion inhibitor sold by BASF Corporation, 100 Park Avenue, Florham Park, N.J. 07932.

In yet another embodiment, the gel composition may also include a carbomer, e.g. 0.5-10 v/v % carbomer. Further, the mixture may be further diluted after adding the corrosion inhibitors and/or the other additives, as needed, and agitated for a predetermined time period. For example, in certain embodiments, the mixture may be agitated at 60° C. from about 8 hours to about 15 hours in a bath so as to form the gel composition. The gel composition is then cooled to room temperature and mixed with the abrasive organic particles.

In addition, the gel composition of the gel detergent 84 may have a viscosity high enough to maintain suspension of the organic particles therein but low enough to allow the composition to flow through the gas turbine engine 10. For example, in certain embodiments, the viscosity of the gel composition may be from about 1,000 to about 50,000 centipoise (cps) at 25 degrees Celsius (i.e. room temperature) under ASTM D2196. For example, at room temperature, and using a 0.5 v/v % addition of Carbomer 941®, the viscosity of the gel composition may be from about 4,000 cps to about 11,000 cps. In another embodiment, at room temperature, and using a 0.5 v/v % addition of Carbomer 934P®, the viscosity of the gel composition may be from about 30,000 cps to about 40,000 cps.

Thus, as shown at 104, the method 100 may also include allowing the gel detergent 84 to flow across or within one or more of the components of the gas turbine engine 10 so as to clean the component(s) thereof. More specifically, the gel detergent 84 is configured to flow across external surfaces of the gas turbine components and/or within passageways of the components.

In further embodiments, the method 100 may include rinsing the gel detergent 84 after allowing the gel detergent 84 to flow across or within one or more of the components. For example, in certain embodiments, the gel composition may be water soluble. Thus, the gel detergent 84 can be easily rinsed after cleaning and does not leave harmful residue behind.

In yet another embodiment, the method 100 may also include injecting a fluid (e.g. such as water) into the gas turbine engine 10 prior to injecting the gel detergent 84 into the gas turbine engine 10 so as to wet one or more surfaces of the components of the gas turbine engine 10. Such initial wetting of the turbine components is configured to further assist cleaning of the components.

Figure 5:
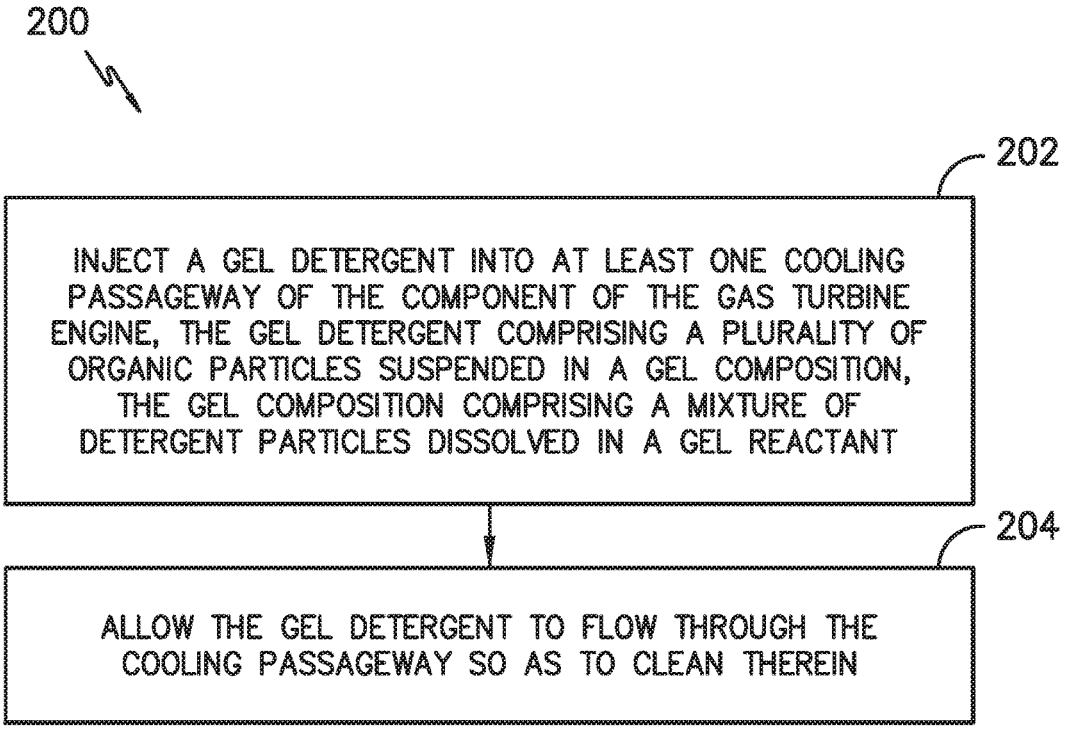
FIG. 5 illustrates a flow diagram of another embodiment of a method for in-situ cleaning of a component of a gas turbine engine according to the present disclosure.

Referring now to FIG. 5, a flow diagram of another embodiment of a method 200 for in-situ or on-wing cleaning of a component of a gas turbine engine 10 is illustrated. As shown at 202, the method 200 includes injecting a gel detergent 84 into a cooling passageway of the component of the gas turbine engine 10. As mentioned, the gel detergent 84 includes a plurality of abrasive organic particles suspended in a gel composition. More specifically, the gel composition includes a mixture of detergent particles dissolved in a gel reactant, e.g. such as the gel reactant described herein. Thus, as shown at 204, the method 200 also includes allowing the gel detergent 84 to flow through the cooling passageway of the component(s) so as to clean therein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for in-situ cleaning one or more components of a gas turbine engine, the method comprising:

securing a supply of gel detergent to a surface of one or more of the components of the gas turbine engine such that an inlet of the supply aligns with an inlet of one or more cooling passageways of the one or more components;

injecting the gel detergent from the inlet of the supply into the aligned inlet of the one or more cooling passageways of the one or more of the components of the gas turbine engine at a predetermined pressure, the gel detergent comprising a plurality of abrasive particles suspended in a gel composition, the plurality of abrasive particles comprising organic material, the gel composition comprising a liquid carrier comprising a mixture of detergent particles diluted in water and dissolved in a gel reactant; and allowing the gel detergent to flow across or within one or more of the components of the gas turbine engine so as to clean one or more of the components.

2. The method of claim 1, wherein the gel composition comprises a viscosity of from about 1,000 to about 50,000 centipoise (cps) so as to maintain suspension of the abrasive particles in the gel composition but to also allow the composition to flow through the gas turbine engine.

3. The method of claim 1, further comprising injecting the gel detergent into one or more ports of the gas turbine engine.

4. The method of claim 1, further comprising rinsing the gel detergent after the gel detergent flows across or within one or more of the one or more components, wherein the gel composition is water soluble.

5. The method of claim 1, further comprising determining the predetermined pressure as a function of at least one of the viscosity of the gel composition or the one or more components of the gas turbine engine.

6. The method of claim 1, wherein the organic material comprises at least one of nut shells or fruit stone pits.

7. The method of claim 1, wherein the plurality of abrasive particles comprise varying-sized particles.

8. The method of claim 1, wherein the each of the plurality of abrasive particles comprises a particle diameter of from about 20 microns to about 500 microns.

9. The method of claim 1, further comprising adding at least one of a corrosion inhibitor or a pH buffer to the gel composition.

10. The method of claim 1, wherein the one or more components of the gas turbine engine comprise at least one of a compressor, a high-pressure turbine, a low-pressure turbine, a combustor, a combustion chamber, a nozzle, one or more blades or vanes, a booster, or a casing of the gas turbine engine.

11. The method of claim 1, wherein the gel reactant comprises a mixture of acrylic and carboxylic acids having a molecular weight range of from about 1,250,000 to about 3,000,000 Daltons.

12. The method of claim 1, wherein the organic material is present in the gel detergent from about 3,000 parts per million (ppm) to about 30,000 ppm, and wherein the residual ash content of the organic material does not exceed 0.05% at 1040° C.

13. The method of claim 4, further comprising, after rinsing, burning off residual organic material left by the plurality of abrasive particles during normal operation of the gas turbine engine.

* * * * *